US007261484B2

(12) United States Patent
Gallagher

(10) Patent No.: US 7,261,484 B2
(45) Date of Patent: Aug. 28, 2007

(54) LOSS PREVENTION DEVICE FOR PENS

(76) Inventor: Thomas Gallagher, 2020 Ave. "D", Council Bluffs, IA (US) 51501

( * ) Notice: Subject to any disclaimer, the term of this patent is extended or adjusted under 35 U.S.C. 154(b) by 0 days.

(21) Appl. No.: 11/591,769

(22) Filed: Nov. 2, 2006

(65) Prior Publication Data

US 2007/0104532 A1 May 10, 2007

Related U.S. Application Data

(60) Provisional application No. 60/734,498, filed on Nov. 8, 2005.

(51) Int. Cl.
*B43K 29/00* (2006.01)
*G08B 13/14* (2006.01)
*G08B 21/00* (2006.01)

(52) U.S. Cl. ..... 401/195; 340/568; 340/571; 340/686; 340/689

(58) Field of Classification Search ..... 401/195; 200/61.45 R, 61.52, 503; 340/568, 571, 340/572, 686, 689
See application file for complete search history.

(56) References Cited

U.S. PATENT DOCUMENTS 4,101,873 A * 7/1978 Anderson et al. ..... 340/539.32
4,291,301 A * 9/1981 Chan ..... 340/568.1

* cited by examiner

*Primary Examiner*—David J. Walczak
(74) *Attorney, Agent, or Firm*—Adam H. Jacobs

(57) ABSTRACT

A loss prevention device for pens includes a pen having an exterior shell generally free of openings therethrough and a writing device housed within the exterior shell and a loss prevention device mounted within the pen which includes a gravity-actuated position sensing switch having an outer electrically conductive cylinder and an inner electrically conductive cylinder mounted within and extending in generally concentric alignment with the outer cylinder, the contact ends of the outer and inner cylinders being generally adjacent to one another such that an electrically conductive ball bearing housed in a generally frustoconical ball bearing chamber can fall into contact with the contact ends of the outer and inner cylinders thereby completing an electrically conductive circuit and initiating an audio-generating programmable electronic device for generating and outputting an audio signal to a loudspeaker when the pen is oriented in a generally horizontal position.

12 Claims, 1 Drawing Sheet

LOSS PREVENTION DEVICE FOR PENS

CROSS-REFERENCE TO RELATED PATENTS

This utility patent application claims priority based on a Provisional Patent Application Ser. No. 60/734,498 filed Nov. 8, 2005.

BACKGROUND OF THE INVENTION

1. Technical Field

The present invention relates to loss prevention devices for objects and, more particularly, to a loss prevention device for a pen which includes a pen having an exterior shell which is free of openings excepting the opening for the writing device to extend out and through and a loss-prevention device mounted within the pen which includes a gravity-actuated position sensing switch having outer and inner electrically conductive cylinders extending in generally parallel concentric alignment with one another, an electrically conductive ball bearing held within a ball bearing chamber adjacent the contact ends of the outer and inner cylinders for contacting the contact ends of the outer and inner cylinders when the pen is placed in a generally horizontal position thereby completing the electrical circuit between the outer and inner cylinders, an audio-generating programmable electronic device for generating an audio signal to a loudspeaker in direct contact with the exterior shell of the pen, and a battery, the gravity-actuated position sensing switch operative to complete the circuit when the pen is in a generally horizontal position thereby triggering the audio-generating programmable electronic device to output an audio signal to the loudspeaker which outputs sounds to inform persons in the vicinity of the pen that the pen is oriented in a generally horizontal position as would occur when the pen had been misplaced or lost.

2. Description of the Prior Art

An important and significant status symbol for many successful business persons is ownership of a fine, expensive pen which he or she carries with them during the day for signing of various documents and other purposes such as taking notes or any other situation requiring use of a writing implement. A high-quality pen or writing instrument provides a luxurious writing experience, one which enhances the performance of everyday activities. However, unlike many other expensive objects, pens are used in many different situations, and are occasionally loaned out for use by other persons. This means that ownership of a fine writing implement carries increased responsibilities to prevent loss or misplacement of the pen, and therefore there is a need for an unobtrusive yet functional loss-prevention device which can be used with such fine writing implements to significantly reduce the risk of loss of the writing implement.

Several devices have been proposed in the prior art which attempt to address and solve this problem, such as Anderson et al., U.S. Pat. No. 4,101,873 and Chan, U.S. Pat. No. 4,291,301. Each of these prior art devices, however, include inherent deficiencies which detract from their functionality and render their inclusion and use in a fine writing implement somewhat problematic. For example, Chan requires that the writing implement include a plurality of sound-releasing holes in the pen body which significantly detract from the appearance of the pen and further will render the pen far more susceptible to incursion of foreign objects and liquids such as if the pen were accidentally dropped in a puddle, glass of water or the like. The holes in the body of the pen, as described in Chan, will instantly permit the external liquid to enter the pen thus, in all likelihood, ruining the pen for future use. Furthermore, Chan teaches to the inclusion of a mercury switch which is extremely dangerous due to the toxic properties of mercury. Finally, Chan does not include any type of delay in initiation of the audio signal from the time the pen is placed in a horizontal position, and this lack of a delay will likely result in a high degree of annoyance from the activation of the alarm in any situation where the pen is placed in a horizontal position. There is therefore a need for a loss-prevention device which addresses and corrects all of the deficiencies found in the prior art and does so in a simple and functional manner.

Therefore, an object of the present invention is to provide an improved loss prevention device for pens.

Another object is to provide an improved loss prevention device for pens which includes a delay activation so that the device does not activate immediately upon the pen being placed in a horizontal position in order to significantly reduce the annoyance factor in the use of such a device and better fulfill the intended purpose of reminding the owner of the pen to retrieve the pen from the horizontal position where it is laying.

Another object of the present invention is to provide an improved loss prevention device for pens in which the pen body does not include any external openings excepting the opening for the writing implement extending therethrough and possibly a top opening for a pen extension switch or the like in order to generally prevent incursion of contaminating liquids and solids into the pen thereby extending the life of the pen and preventing damage to the internal components of the pen.

Finally, an object of the present invention is to provide an improved loss prevention device for pens which is relatively simple and durable in design and construction and is safe, efficient and effective in use.

SUMMARY OF THE INVENTION

The present invention provides a loss prevention device for pens including a pen having an exterior shell, an interior volume and a writing device housed within the exterior shell, the exterior shell being free of openings therethrough excepting an opening for the writing device to extend out and through and a loss-prevention device mounted within the exterior shell of the pen. The loss-prevention device includes a gravity-actuated position sensing switch mounted within the exterior shell of the pen which has an outer electrically conductive cylinder having a contact end and an inner electrically conductive cylinder having a contact end and mounted within and extending in generally concentric alignment with the outer cylinder. The contact ends of the outer and inner cylinders are generally adjacent to one another. An electrically conductive ball bearing is movably housed within a generally frustoconical ball bearing chamber having a wide end adjacent the contact ends of the outer and inner cylinders and a narrow end, the ball bearing chamber positioned within the exterior shell of the pen such that when the pen is generally horizontal, the ball bearing falls out of the narrow end towards and into the wide end of the ball bearing chamber and contacts the contact ends of both of the outer and inner cylinders thereby completing an electrically conductive circuit between the outer and inner cylinders through the ball bearing. An audio-generating programmable electronic device is housed within the pen for generating an audio signal and a loudspeaker is mounted within the pen in audio signal transmission connection with the audio-generating programmable electronic device, the loudspeaker in direct contact with the exterior shell of the pen for transmission of audio output to and through the exterior shell. A battery is in power transmission connection with the audio-generating programmable electronic device and the loudspeaker. Finally, the gravity-actuated position sensing switch is in operative connection with the audio-generating programmable electronic device such that upon the pen being placed in a generally horizontal position, the ball bearing completes the circuit between the outer and inner cylinders thereby triggering the audio-generating programmable electronic device to output an audio signal to the loudspeaker means which outputs sound to and through the exterior shell of the pen thereby signaling that the pen is oriented in a generally horizontal position.

The loss-prevention device for pens as thus described provides substantial advantages over the various loss prevention devices described in the prior art. For example, because the present invention does not include any external openings through the body of the pen excepting the opening through which the writing implement extends, incursion of external contaminants such as solids and liquids into the interior of the pen is generally prevented, thus extending the operating life of the pen and generally preventing damage to the internal elements thereof. Also, because of the generally sealed mechanical nature of the gravity switch of the present invention, proper operation of the position-sensing switch is greatly facilitated, thus ensuring operation of the unit to remind the owner or user of the pen that he or she has placed the pen in a horizontal position where it is more likely to be forgotten. Finally, because the present invention includes a timer which operates to prevent initiation of the generating of the audio signal, it is far more likely that triggering of the present invention occurs in response to an actual forgetting or losing of the pen rather than the user of the pen merely setting the pen down in a horizontal position for a short period of time. This makes it far more likely that use of the present invention will provide a significant benefit to the owner of the pen rather than merely providing an annoyance to the owner of the pen. The present invention thus provides a substantial improvement over those devices and systems found in the prior art.

DESCRIPTION OF THE PREFERRED EMBODIMENT

Figures 1, 2, 3:
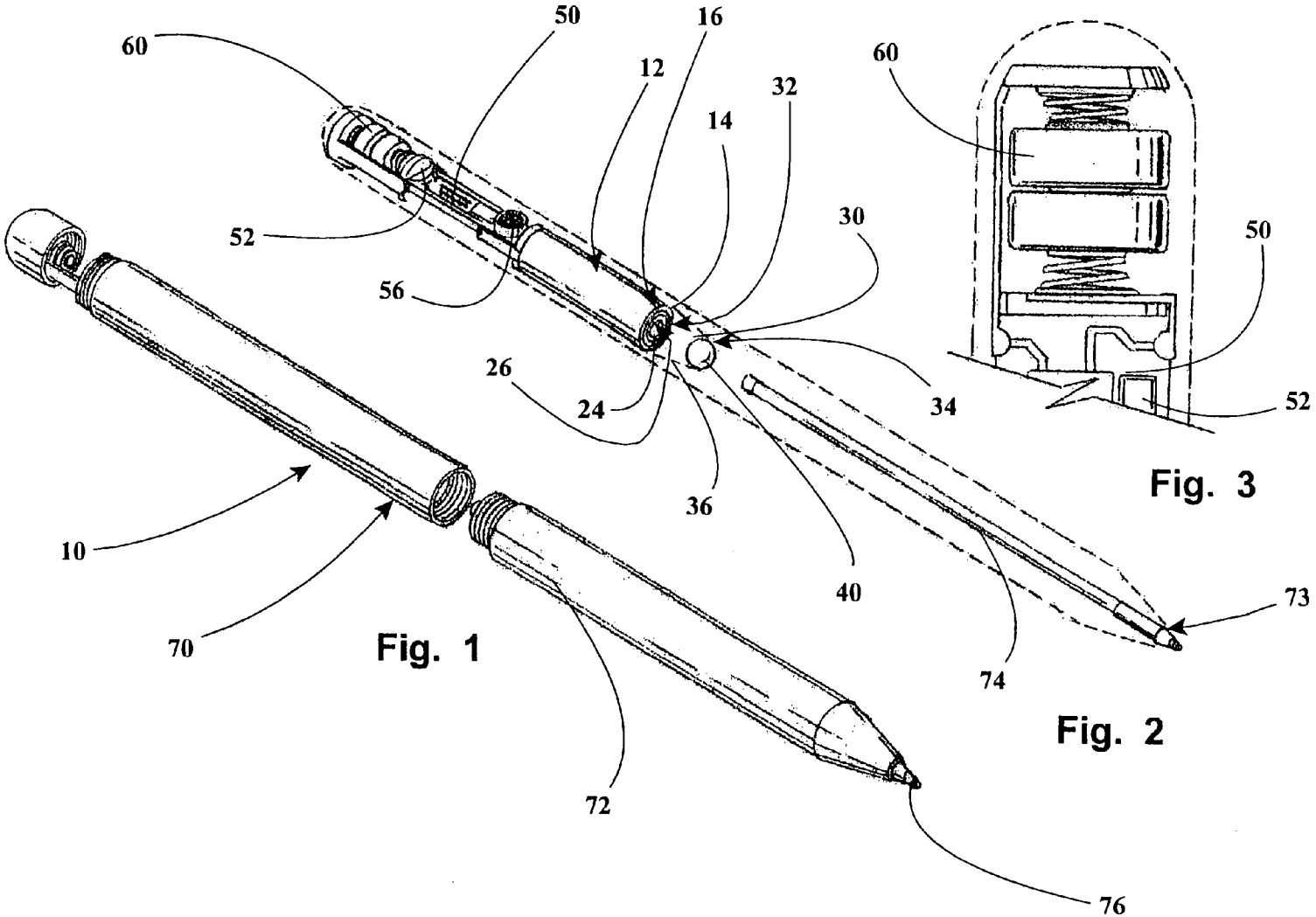
FIG. 1 is a perspective view of the external features of the pen of the present invention.
FIG. 2 is a detailed perspective view of the present invention showing the internal elements thereof, specifically the loss prevention device fitted within the pen.
FIG. 3 is a detailed side elevational view of the batteries and circuitry of the present invention which provide power to the functional elements of the invention.

The loss prevention device for pens 10 of the present invention is shown best in FIGS. 1-3 as including a pen 70 having an exterior shell 72 with a writing device 74, such as a. replaceable ink cartridge and ballpoint pen, being held within and supported by the exterior shell 72 with the writing end 76 of the writing device 74 extending out of the lower end of the exterior shell 72. In the preferred embodiment, the writing end 76 would extend out through the lower opening 73 and exterior shell 72, and the exterior shell 72 itself may be constructed in one or more sections which would be threadably or slidably connected to one another in the manner commonly found in connection with high-quality writing pens currently found in the art. In the preferred embodiment, the exterior shell 72 would be constructed of a high-quality metal or plastic material, although the exact construction material used in connection with the pen 70 is not critical to the present invention.

Mounted within the exterior shell 72 of pen 70 is the actual loss-prevention device 10 which includes, in the preferred embodiment, a gravity-actuated position sensing switch 12, as shown best in FIG. 2. The gravity-actuated position sensing switch 12 is preferably constructed as including outer and inner electrically conductive cylinders 14 and 24, each being constructed of an electrically conductive material such as metal, specifically copper or brass, with the inner cylinder 24 fitting within the outer cylinder 14 in a generally parallel concentric alignment. In the preferred embodiment, the outer and inner cylinders 14 and 24 would be of approximately the same length and would each end in a contact end 16 and 26 at the lower end of. each of the outer and inner cylinders 14 and 24, as shown best in FIG. 2. The contact ends 16 and 26 of the outer and inner cylinders 14 and 24 are spaced apart from one another one-half to three millimeters. It is further preferred that the outer and inner cylinders 14 and 24 be spaced from one another approximately one to two millimeters and further that the outer cylinder 14 be negatively charged and the inner cylinder 24 be positively charged.

Extending downwards from the contact ends 16 and 26 of outer and inner cylinders 14 and 24 is a generally frusto-conical ball bearing chamber 30 which, in the preferred embodiment, would be constructed of non-conductive material such as plastic or the like and which would include a wide end 32 generally adjacent the outer and inner cylinders 14 and 24 and a narrow end 34 positioned downwards from the outer and inner cylinders 14 and 24, as shown in FIG. 2. In the preferred embodiment, the slope of the walls 36 of the ball bearing chamber 30 from vertical would be approximately five to fifteen degrees such that when the pen 70 is placed on its side, the walls 36 of ball bearing chamber 30 tilt downwards towards the outer and inner cylinders 14 and 24 of the sensing switch 12. A ball bearing 40 is mounted within the ball bearing chamber 30, the ball bearing 40 being free to move within the ball bearing chamber 30, the ball bearing 40 further being constructed of an electrically conductive metal material similar to that used in connection with the outer and inner cylinders 14 and 24 of gravity-actuated position sensing switch 12. It is expected that the ball bearing 40 would be of a generally standard size, although modification of the size of the ball bearing 40 should be understood to be a part of this disclosure, so long as the ball bearing 40 is generally spherical in shape to move freely within the ball bearing chamber 30.

Housed within the exterior shell 72 of pen 70 above the gravity-actuated position sensing switch 12 are the remaining elements of the loss prevention device 10 of the present invention. Specifically, these elements include an audio-generating programmable electronic chip 50, a loudspeaker device 56, and one or more batteries 60, as shown best in FIGS. 2 and 3. In the preferred embodiment, programmable electronic chip 50 would be of a standard EPROM design which would be programmed to include one or more electronic audio files in the random access memory (RAM), flash memory or read only memory (ROM) of the programmable electronic chip 50, and these electronic audio files may be of any appropriate file type such as .AU, .RAM, .WAV, or .MP3. The programmable electronic chip 50 would further be programmed to output these electronic audio files in an appropriate playback format to the loudspeaker 56 when triggered to do so by the mechanism as will be described later herein. The batteries 60 are connected in power transmission connection to the programmable electronic chip 50 and loudspeaker 56 to provide power to the various elements, with the actual circuit between the batteries 60 and the programmable electronic chip 50 and loudspeaker 56 passing through the gravity-actuated position sensing switch 12, specifically with the negative contact connected to the upper end of outer cylinder 14 and the positive end connected to the upper end of inner cylinder 24. Therefore, power to the programmable electronic chip 50 and loudspeaker 56 via batteries 60 only occurs upon completion of the circuit between the outer cylinder 14 and inner cylinder 24 as will be described immediately hereafter.

Specifically, the loss prevention device 10 of the present invention is designed to function when the pen 70 is moved from a vertical or generally upright position to a generally horizontal position as would happen if the pen 70 were laid on a table or other such horizontal surface. It has been found that the vast majority of times that a pen 70 is mistakenly left behind or lost, it is in a horizontal position on a horizontal surface somewhere where the owner was previously. When such an event occurs with a pen 70 outfitted with the loss prevention device 10 of the present invention, the horizontal positioning of the pen 70 results in the ball bearing chamber 30 laying sideways, thus causing walls 36 of ball bearing chamber 30 to be tilted downwards. This causes the ball bearing 40 housed within ball bearing chamber 30 to roll down walls 36 towards the contact ends 16 and 26 of outer and inner cylinders 14 and 24. When the ball bearing 40 contacts the contact ends 16 and 26 of outer and inner cylinders 14 and 24, the circuit between the outer and inner cylinders 14 and 24 is completed via ball bearing 40 and thus current flows from the batteries 60 to the programmable electronic chip 50 and loudspeaker 56. This triggers the programmable electronic chip 50 to begin counting down the seconds via a delay timer 52 fitted into the programmable electronic chip 50 or positioned adjacent thereto in operative connection therewith, the delay timer 52 operative to delay activation of the sound emission capabilities of the present invention for a predetermined period of time. It is expected that the delay timer 52 will be set to delay output of the audio signal a period likely between fifteen seconds and one minute before permitting engagement of the programmable electronic chip 50, and it is believed that this delay will be important in encouraging use of the present invention, as the device will not immediately signal orientation of the pen 70 in a horizontal position unless such delay is modified by the user of the present invention.

Once the delay timer 52 has expired, the programmable electronic chip 50 outputs a designated electronic audio file to the loudspeaker 56 which broadcasts the audio file per the instructions of the programmable electronic chip 50. This audio file may be of any appropriate kind, such as a beeping, buzzing, or even may be an actual song, such as a college fight song or the like which will have a greater meaning for the owner of the pen 70 outfitted with the present invention. Such inclusion of various types of audio files is well within the purview of this invention, however, and programming of the programmable electronic chip 50 to include such audio files would be understood by one skilled in the art of such programming. The activation of the loudspeaker 56 thus outputs the selected sound file to the area external of the pen 70, thus signifying to persons nearby that the pen 70 has been left in its horizontal position for a period exceeding the specified delay time, and thus signifying, in all likelihood, the pen 70 has accidentally been left behind by the owner. This will hopefully cause the owner to return to the pen 70 and pick it back up, thus causing the ball bearing 40 to disconnect from the contact ends 16 and 26 of outer and inner cylinders 14 and 24, thus breaking the circuit and causing the programmable electronic chip 50 and loudspeaker 56 to lose power and cease broadcasting. The loss-prevention device 10 of the present invention is thus once again ready for another situation should one arise.

It is important to note that one of the main features of the loss prevention device 10 of the present invention is that it fits within the exterior shell 72 of pen 70 without requiring an additional opening for broadcasting of the sound from loudspeaker 56 to the area external of the pen 70. This is because the loudspeaker 56, in the preferred embodiment, is mounted directly against the exterior shell 72 of pen 70 in such a manner that the vibration and movement of the loudspeaker 56 is transferred directly to the exterior shell 72 of pen 70. The exterior shell 72 acts as an extension of the loudspeaker 56 helping to broadcast the sound output of the loudspeaker 56 while simultaneously vibrating to increase awareness of the activation of the loss prevention device 10 of the present invention. A significant advantage of the positioning of the loudspeaker 56 directly contacting the exterior shell 72 is that there is no need for additional openings in the exterior shell 72 to release the sound from the loudspeaker 56, thus preventing incursion of external contaminants into the interior of the pen 70, which could potentially degrade performance of the pen 70 and eventually require replacement of the entire pen 70.

It to be understood that numerous additions, modifications and substitutions may be made to the loss prevention device for pens 10 of the present invention which fall within the intended broad scope of the appended claims. For example, the size, shape, and construction materials used in connection with the loss-prevention device 10 may be modified or changed so long as the intended functional features of the present invention are neither degraded nor destroyed. Furthermore, it should be noted that although the gravity-actuated positioning sensing switch 12 has been described with some particularity, minor modifications in the design may be incorporated into the present invention, such as substituting the outer and inner cylinders 14 and 24 with parallel plates (not shown) which would function in the same manner when the ball bearing 40 slides downwards simultaneously contacting the contact ends of such plates. Such modifications should be understood to be a part of this disclosure and their use would be understood by one versed in the art of this disclosure once having read and understood this document. Finally, it should be noted that the precise nature of the programmable electronic chip 50, loudspeaker 56, and batteries 60 may be modified or changed depending on available technology so long as the batteries 60 function to provide electrical power to the programmable electronic chip 50 and loudspeaker 56, the loudspeaker 56 functions to output sound waves therefrom, and the programmable electronic chip 50 is triggerable via activation of the gravity-actuated positioning sensing switch 12 to output a selected audio file to the loudspeaker 56.

There has therefore been shown and described a loss prevention device 10 for pens which accomplishes at least all of its intended objectives.

I claim:

1. A loss prevention device for pens comprising:

a pen having an exterior shell, an interior volume and a writing device housed within said exterior shell, said exterior shell being free of openings therethrough excepting an opening for said writing device to extend out and through;

a loss prevention device mounted within said exterior shell of said pen, said loss-prevention device including;

a gravity-actuated position sensing switch mounted within said exterior shell of said pen and having;

an outer electrically conductive cylinder having a contact end;

an inner electrically conductive cylinder having a contact end and mounted within and extending in generally concentric alignment with said outer cylinder;

said contact ends of said outer and inner cylinders being generally adjacent to one another;

an electrically conductive ball bearing;

a generally frustoconical ball bearing chamber having a wide end adjacent said contact ends of said outer and inner cylinders and a narrow end, said ball bearing chamber positioned within said exterior shell of said pen such that when said pen is generally horizontal, said ball bearing falls out of said narrow end towards and into said wide end of said ball bearing chamber and contacts said contact ends of both of said outer and inner cylinders thereby completing an electrically conductive circuit between said outer and inner cylinders through said ball bearing;

an audio-generating programmable electronic device for generating an audio signal;

loudspeaker means in audio signal transmission connection with said audio-generating programmable electronic device, said loudspeaker means in direct contact with said exterior shell of said pen for transmission of audio output to and through said exterior shell;

battery means in power transmission connection with said audio-generating programmable electronic device and said loudspeaker means;

said gravity-actuated position sensing switch in operative connection with said audio-generating programmable electronic device such that upon said pen being placed in a generally horizontal position, said ball bearing completes the circuit between said outer and inner cylinders thereby triggering said audio-generating programmable electronic device to output an audio signal to said loudspeaker means which outputs sound to and through said exterior shell of said pen thereby signaling that said pen is oriented in a generally horizontal position.

2. The loss prevention device for pens of claim 1 further comprising a delay timer operatively connected to said audio-generating programmable electronic device for delaying activation of said audio-generating programmable electronic device upon said gravity-actuated position sensing switch engaging whereby said pen will lay in a generally horizontal position for a selected period of time prior to outputting of sound from said loudspeaker means.

3. The loss prevention device for pens of claim 1 wherein said audio-generating programmable electronic device is an electronic programmable read-only memory chip (EPROM).

4. The loss prevention device for pens of claim 1 wherein said ball bearing is generally spherical in shape and is constructed of an electrically conductive metal material.

5. The loss prevention device for pens of claim 1 wherein said outer electrically conductive cylinder and said inner electrically conductive cylinder are constructed of an electrically conductive metal material.

6. The loss prevention device for pens of claim 1 wherein said contact ends of said outer and inner cylinders are spaced from one another one-half to three (½ to 3) millimeters.

7. A loss prevention device for pens comprising:

a pen having an exterior shell, an interior volume and a writing device housed within said exterior shell;

a loss prevention device mounted within said exterior shell of said pen, said loss-prevention device including;

a gravity-actuated position sensing switch mounted within said exterior shell of said pen and having;

an outer electrically conductive cylinder having a contact end;

an inner electrically conductive cylinder having a contact end and mounted within and extending in generally concentric alignment with said outer cylinder;

said contact ends of said outer and inner cylinders being generally adjacent to one another;

an electrically conductive ball bearing;

a ball bearing chamber positioned within said exterior shell of said pen generally adjacent said contact ends of said outer and inner cylinders having a shape such that when said pen is generally horizontal, said ball bearing moves towards and contacts said contact ends of both of said outer and inner cylinders simultaneously thereby completing an electrically conductive circuit between said outer and inner cylinders through said ball bearing;

an audio-generating programmable electronic device for generating an audio signal;

loudspeaker means in audio signal transmission connection with said audio-generating programmable electronic device, said loudspeaker means in direct contact with said exterior shell of said pen for transmission of audio output to and through said exterior shell;

a delay timer operatively connected to said audio-generating programmable electronic device for delaying activation of said audio-generating programmable electronic device upon said gravity-actuated position sensing switch engaging;

battery means in power transmission connection with said audio-generating programmable electronic device, said delay timer and said loudspeaker means;

said gravity-actuated position sensing switch in operative connection with said audio-generating programmable electronic device such that upon said pen being placed in a generally horizontal position, said ball bearing completes the circuit between said outer and inner cylinders thereby triggering said audio-generating programmable electronic device to output an audio signal to said loudspeaker means which outputs sound to and through said exterior shell of said pen thereby signaling that said pen is oriented in a generally horizontal position.

8. The loss prevention device for pens of claim 7 wherein said audio-generating programmable electronic device is an electronic programmable read-only memory chip (EPROM).

9. The loss prevention device for pens of claim 7 wherein said ball bearing is generally spherical in shape and is constructed of an electrically conductive metal material.

10. The loss prevention device for pens of claim 7 wherein said outer electrically conductive cylinder and said inner electrically conductive cylinder are constructed of an electrically conductive metal material.

11. The loss prevention device for pens of claim 7 wherein said contact ends of said outer and inner cylinders are spaced from one another one-half to three (½ to 3) millimeters.

12. The loss prevention device for pens of claim 7 wherein said ball bearing chamber is generally frustoconical in shape having a wide end adjacent said contact ends of said outer and inner cylinders and a narrow end, said ball bearing chamber positioned within said exterior shell of said pen such that when said pen is generally horizontal, said ball bearing falls out of said narrow end towards and into said wide end of said ball bearing chamber and contacts said contact ends of both of said outer and inner cylinders thereby completing an electrically conductive circuit between said outer and inner cylinders through said ball bearing.

* * * * *